US005856375A

United States Patent [19]

Chang et al.

[11] Patent Number: 5,856,375

[45] Date of Patent: Jan. 5, 1999

[54] USE OF BISPHENOL A TAR IN FURAN NO-BAKE FOUNDRY BINDERS

[75] Inventors: Ken K. Chang, Dublin; Michael C. Clingerman, Hilliard; Michelle L. Lott, Waverly; James T. Schneider, Dublin, all of Ohio

[73] Assignee: Ashland, Inc., Columbus, Ohio

[21] Appl. No.: 583,178

[22] Filed: Jan. 4, 1996

[51] Int. Cl.[6] ..... B22C 1/22

[52] U.S. Cl. ..... 523/145; 524/493; 524/593; 524/594; 524/876

[58] Field of Search ..... 523/145; 524/493, 524/876, 593, 594

[56] References Cited

U.S. PATENT DOCUMENTS 5,552,509 9/1996 Takashima et al. ..... 528/129

5,607,986 3/1997 Kim et al. ..... 523/141

*Primary Examiner*—Vasu Jagannathan
*Assistant Examiner*—John J. Guarriello
*Attorney, Agent, or Firm*—Mueller and Smith,LPA

[57] ABSTRACT

Broadly, the present invention relates to furan no-bake foundry binders where bisphenol A tar (BPAT) is used to replace a portion of the furfuryl alcohol and any conventional filler optionally included in for binder formulation. Reduction in the amount of furfuryl alcohol in the foundry binder formulation may lead to a reduction in the cost and an improvement in early strength of these formulations. Accordingly, in a furan no-bake foundry binder of a resin derived from a major proportion of furfuryl alcohol and optionally fillers, the improvement which comprises at least a fraction of said furfuryl alcohol being bisphenol A tar. Bisphenol A tar also can replace at least a fraction of any filler included in the binder formulation.

11 Claims, No Drawings

USE OF BISPHENOL A TAR IN FURAN NO-BAKE FOUNDRY BINDERS

BACKGROUND OF THE INVENTION

The present invention relates to the manufacture of no-bake foundry binders and more particularly to a furan no-bake foundry binder containing bisphenol A tar (BPAT) filler. A "no-bake foundry binder", as used herein, means an organic chemical solution that is mixed into foundry sand and cured at ambient temperature by the action of an acid catalyst. The cured sand forms are used in metal casting operations.

Furfuryl alcohol is the key ingredient in furan no-bake foundry sand mold and core formulations. Furfuryl alcohol often is in short supply and is high in cost. Inexpensive fillers are used to reduce the cost of these formulations by replacing at least a fraction of the furfuryl alcohol. Such fillers must be compatible with the ingredients in the formulation. Most such fillers are by-products resulting from various industrial processes. Examples of such traditional fillers include residues from the ozone oxidation production of azeleic acid; by-products (mixed esters) from the production of terephthalic acid and its esters; lignins and lignosulfonates from the paper industry; and various rosins from the forest industry.

Heretofore, for example, bisphenol A tar has been proposed for use in phenolic-based, heat-cured foundry shell resin formulations (British Pat. No. 2,271,357).

BROAD STATEMENT OF THE INVENTION

Broadly, the present invention relates to furan no-bake foundry binders where bisphenol A tar (BPAT) is used to replace conventional fillers and furfuryl alcohol in the foundry binder formulation. Accordingly, in a furan no-bake foundry binder derived from a major proportion of furfuryl alcohol and, optionally, phenol formaldehyde polymers and furfuryl alcohol polymers; and filler materials, such as terephthalic acid esters, azelaic acid synthesis by-products, and the like, the improvement incorporates BPAT as all or a fraction of said fillers, and a major proportion of furfuryl alcohol.

Advantages of the present invention include the ability to substitute an expensive foundry binder ingredient, furfuryl alcohol, with an inexpensive ingredient, BPAT, without sacrificing performance. Another advantage is the faster strip times achievable with BPAT formulations compared to conventional fillers, which can lead to higher productivity in the foundry. A further advantage is the high initial core and/or mold strengths seen using the BPAT formulations, which can lead to less breakage and waste in the foundry. These and other advantages will be readily apparent to those skilled in the art based on the disclosure contained herein.

DETAILED DESCRIPTION OF THE INVENTION

Conventional furan no-bake foundry formulations rely on furfuryl alcohol and often on additional resinous materials to enhance certain properties. These resinous materials include phenolic polymers with formaldehyde and/or urea formaldehyde, such as resoles (see U.S. Pat. No. 3,676,392 for PEP, or polyether phenol, resole resins), used at 0–50 wt-% levels, and furfuryl alcohol polymers with formaldehyde and/or urea formaldehyde copolymers at 0–95 wt-% levels. Other constituents include resorcinol (between about 0 and 10 wt-%), an alkanol such as methanol (between about 0 and 10 wt-%), silanes (between about 0 and 4 wt-%), and fillers (between about 0 and 75 wt-%). Further information on these formulations can be found by reference to Langer, et al., "Foundry Resins", *Encyclopedia of Polymer Science and Engineering*, Vol. 7, Second Edition, pages 290–298, John Wiley & Sons, Inc. (1987). See also Solomon, *The Chemistry of Organic Film Formers*, Second Edition, pages 253 et seq., Robert E. Krieger Publishing Company, Huntington, N.Y. ((1977). The disclosures of these references are expressly incorporated herein by reference.

Conventional fillers include, for example, residues or bottoms from the production of azelaic acid by the ozone oxidation process (formerly available from Henkel Corporation, Emery Group); by-products (mixed esters) from the production of terephthalic acid and its esters; lignins and lignosulfonates from the paper industry; various rosins from the forest industry; and the like and even mixtures thereof. Such fillers need be compatible with the no-bake foundry formulations (e.g., resole resins) and are used to reduce the amount of furfuryl alcohol, thereby reducing for formula cost.

Such conventional fillers are at least partially, if not fully, replaced with bisphenol A tar (BPAT) in accordance with the present invention. Further, furfuryl alcohol can be replaced in formulations that currently do not contain fillers with no loss of performance properties. BPAT is a by-product of the manufacture of bisphenol A (BPA). It is a solid, crystalline material comprised primarily of BPA (approximately 70 wt-%) and other by-products, such as, dimers, trimers, and phenol (in aggregate, approximately 30 wt-%), of bisphenol A production. While pure BPA can be utilized as a filler replacement in accordance with the teachings of the present invention, it is more costly then BPAT. Thus, the amount of BPAT can range up to about 75 wt-% and advantageously it ranges from about 1% to 25% by weight.

Unexpectedly, it was determined that with the use of BPAT filler in a furan no-bake foundry binder formulation, faster strip times were realized than with conventional filler or without filler. Faster strip times translate into higher productivity in the foundry. Also, high initial core and/or mold strengths were seen with the use of BPAT filler compared to conventional filler. Improved early strengths translate into less breakage and waste in the foundry. Alternatively, the foundry may choose to use less acid catalyst or a less expensive catalyst, saving money and achieving equal performance. The low cost of BPAT also translates into less expensive foundry binder formulations.

The sand used in the examples is conventional silica sand. Other sands or aggregate material also can be used by adjusting the amount of acid catalyst used to account for the acidity or basicity of the alternate sand or aggregate. Additives to the sand or other aggregate include, for example, iron oxide, ground flax fibers, flour, cellulosics, and the like.

The following examples show how the invention has been practiced, but should not be construed as limiting. All percentages and proportions herein are by weight and all citations are expressly incorporated herein by reference.

EXAMPLES

Example 1

The formulations set forth below were used to evaluate BPAT against a traditional filler, Emery acid 9867 (azelaic acid bottoms by-product, mostly by-product acids, from ozone oxidation process to produce Emerox® azelaic acid, formerly available from the Emery Group of Henkel Corporation) in a furan no-bake foundry binder system.

TABLE 1

| Ingredient | Formulation 1 Control (pbw)* | Formulation 2 Inventive (pbw) | Formulation 3 Inventive (pbw) |
|---|---|---|---|
| Furfuryl alcohol | 76.6 | 76.6 | 74.6 |
| Resorcinol | 2.5 | 2.5 | 2.5 |
| Methanol | 2.0 | 2.0 | 2.0 |
| Emery acid | 18.8 | — | — |
| BPAT | — | 18.8 | 20.8 |
| Silane | 0.1 | 0.1 | 0.1 |

*pbw = parts by weight

The ingredients in each formulation were added to an 8 oz jar and shaken until dissolved to a clear amber solution. To 3600 gm of Wedron 540 sand, 11.25 gm of an aromatic sulfonic acid catalyst solution was added and mixed for one minute in a Hobart N50 mixer. This sand mixture then was manually flipped and mixed for another minute. Each formulation (33.75 g) was added to the sand mix and the mix procedure repeated The final mix was immediately placed into a "dog bone" test form and pressed firmly into place.

The time recorded for the "work time/strip time" measurement began after the mix was complete. "Work time" is defined as the time it takes for the mix to reach 60 hardness on a Green Hardness "B" Scale Tester (Dietert Co., Detroit, Mich.). "Strip time" is the time at which the molds are hard enough to remove and handle, as measured by the time it takes the mix to reach 90 on the same scale.

The dog bones were stripped and timing for the tensile testing begun. Tensile strengths were run on a Thwing Albert QC-1000 tensile tester equipped with a 1000 lb load cell at 2"/min. The results recorded are set forth in Table 2, below.

TABLE 2

| | Tensile Strength (psi) | | | | | |
|---|---|---|---|---|---|---|
| Formulation | @ 1 Hr | @ 3 Hr | @ 24 Hr | @ 24 + 1 Hr* | Tw* (min) | Ts* (min) |
| Control 1 | 56 | 238 | 284 | 176 | 16 | 29 |
| Inventive 2 | 156 | 212 | 259 | 139 | 7 | 13 |
| Inventive 3 | 142 | 189 | 183 | 147 | 7 | 13 |

*24 + 1 Hr = 24 hours at ambient plus 1 hour aging at 90% humidity at 25° C.
Tw = work time
Ts = strip time These data show that the BPAT formulations have greater initial tensile strengths and shorter work times/strip times than the Control formulation. The tensile strengths after 3 hours tended to be not as high as those for the traditional filler, however, the BPAT formulation tensile strengths are quite adequate for most commercial furan no-bake foundry binder applications.

Example 2

The formulations set forth below were used to evaluate BPAT as an furfuryl alcohol replacement in a phenolic modified furan no-bake foundry binder formulation.

TABLE 3

| Ingredient | Formulation 5 Control (pbw)* | Formulation 6 Inventive (pbw) | Formulation 7 Inventive (pbw) |
|---|---|---|---|
| Furfuryl alcohol | 60.76 | 48.76 | 54.76 |
| Phenol formaldehyde resin | 10.76 | 10.76 | 10.76 |
| Furan reacted base | 28.33 | 28.33 | 28.33 |
| BPAT | — | 12.0 | 6.0 |
| Silane | 0.15 | 0.15 | 0.15 |

*pbw = parts by weight

Each formulation was compounded and tested as described above in Example 1. The results recorded are set forth in Table 4, below.

TABLE 4

| | Tensile Strength (psi) | | | | | |
|---|---|---|---|---|---|---|
| Formulation | @ 1 Hr | @ 3 Hr | @ 24 Hr | @ 24 + 1 Hr* | Tw* (min) | Ts* (min) |
| Control 4 | 98 | 344 | 401 | 206 | 18 | 30 |
| Inventive 5 | 118 | 307 | 308 | 188 | 15 | 24 |
| Inventive 6 | 131 | 373 | 385 | 230 | 16 | 25 |

*24 + 1 Hr = 24 hours at ambient plus 1 hour aging at 90% humidity at 25° C.
Tw = work time
Ts = strip time These data again show that the BPAT formulations can replace more expensive furfuryl alcohol while still at least maintaining, if not improving, performance of the resulting foundry binders.

We claim:

1. In a furan no-bake foundry binder of a resin derived from furfuryl alcohol, the improvement which comprises between about 1 wt-% and 75 wt-% of said furfuryl alcohol being replaced with bisphenol A tar.

2. The improved foundry binder of claim 1, which additionally contains one or more of a filler, a furfuryl alcohol resin, a urea formaldehyde copolymer, a phenolic resin, resorcinol, an alkanol, and a silane.

3. The improved foundry binder of claim 1, wherein the proportion of bisphenol A tar ranges from between about 1% and 25% by weight.

4. The improved foundry binder of claim 1, wherein the proportion of furfuryl alcohol is between about 1% and 98%, and said binder additionally contains between about 1% and 95% of one or more of a furfuryl alcohol resin, a phenolic resin, a urea formaldehyde copolymer, or mixtures thereof, all percentages being by weight.

5. The improved foundry binder of claim 1 which additionally contains fillers which include bisphenol A tar.

6. A method for improving a furan no-bake foundry binder of a resin derived from furfuryl alcohol and optional fillers, the improvement which comprises replacing between about 1 wt-% and 75 wt-% said furfuryl alcohol with bisphenol A tar.

7. The method of claim 6, wherein the proportion of bisphenol A tar ranges from between about 1% and 25% by weight.

8. The method of claim 6, wherein the proportion of wherein the proportion of furfuryl alcohol is between about 1% and 98%, and said binder additionally contains between about 1% and 95% of one or more of a furfuryl alcohol resin, a phenolic resin, a urea formaldehyde copolymer, or mixtures thereof, all percentages being by weight.

9. The method of claim 6, wherein said binder includes furfuryl alcohol and filler and said bisphenol A tar replaces at least a fraction of one or more of said furfuryl alcohol or said filler.

10. The method of claim 6, wherein said binder is cured in the presence of an acid catalyst.

11. The method of claim 10, wherein said acid catalyst is one or more of a sulfonic acid or phosphoric acid.

* * * * *